US009548158B2

(12) United States Patent
Groves et al.

(10) Patent No.: US 9,548,158 B2
(45) Date of Patent: Jan. 17, 2017

(54) 3D MULTIPATH INDUCTOR

(71) Applicant: GLOBALFOUNDRIES, INC., Grand Cayman (KY)

(72) Inventors: Robert A. Groves, Highland, NY (US); Sarath L. K. Parambil, Calicut (IN); Venkata Nr. Vanukuru, Karnataka (IN)

(73) Assignee: GLOBALFOUNDRIES INC., Grand Cayman (KY)

( * ) Notice: Subject to any disclaimer, the term of this patent is extended or adjusted under 35 U.S.C. 154(b) by 122 days.

(21) Appl. No.: 14/558,411

(22) Filed: Dec. 2, 2014

(65) Prior Publication Data

US 2016/0155558 A1 Jun. 2, 2016

(51) Int. Cl.

| | |
|---|---|
| ***H01F 5/00*** | (2006.01) |
| ***H01F 27/28*** | (2006.01) |
| ***H01F 41/04*** | (2006.01) |
| ***H01F 17/00*** | (2006.01) |

(52) U.S. Cl.

CPC ..... *H01F 41/041* (2013.01); *H01F 17/0013* (2013.01); *H01F 2017/002* (2013.01)

(58) Field of Classification Search

CPC ..... H01F 5/00; H01F 27/28
USPC ..... 336/200, 232
See application file for complete search history.

(56) References Cited

U.S. PATENT DOCUMENTS 2,843,829 A * 7/1958 Slate ..... H01F 17/0006 336/186
5,559,360 A * 9/1996 Chiu ..... H01F 17/0006 257/531
6,194,987 B1 * 2/2001 Zhou ..... H01L 23/5227 336/200
6,459,352 B1 10/2002 Liu et al.
6,806,558 B2 * 10/2004 Apel ..... H01P 5/10 257/662
7,298,238 B1 11/2007 Eaton et al.
7,391,292 B2 6/2008 Maeda et al.
7,902,953 B1 3/2011 Watt
8,143,952 B2 3/2012 Kim et al.
8,198,970 B2 6/2012 Choi et al.
(Continued)

OTHER PUBLICATIONS

Groves, R., et al. "High-Q Multipath Parallel Stacked Inductor" U.S. Appl. No. 14/242,425, filed Apr. 1, 2014 (44 Pages).
(Continued)

*Primary Examiner* — Tsz Chan
(74) *Attorney, Agent, or Firm* — David Cain; Hoffman Warnick, LLC

(57) ABSTRACT

A three-dimensional multipath inductor includes turns disposed about a center region on two layers, the turns on the two layers having corresponding geometry therebetween. Each of the turns is comprised of two or more segments that extend length-wise along the turns, and the segments have positions that vary from an innermost position relative to the center region and an outermost position relative to the center region. A lateral cross-over is configured to couple the segments of at least one turn on one layer with the segments on a turn on a same layer to form segment paths that have a substantially same length for all segment paths in a grouping of segment paths on that same layer. A vertical cross-over is configured to couple the segments on different vertically stacked metal layers to have the segment groups with a substantially same length for all segment paths based on vertical lengths.

21 Claims, 10 Drawing Sheets

(56) References Cited

U.S. PATENT DOCUMENTS

| | | | | |
|---|---|---|---|---|
| 8,325,001 | B2 | 12/2012 | Huang et al. | |
| 8,339,233 | B2 | 12/2012 | Tsai et al. | |
| 8,754,736 | B2 | 6/2014 | Groves et al. | |
| 2003/0030532 | A1* | 2/2003 | Iida | H01F 17/0006 336/200 |
| 2006/0125046 | A1 | 6/2006 | Bae et al. | |
| 2011/0133877 | A1* | 6/2011 | Chiu | H01F 17/0013 336/200 |
| 2012/0044034 | A1* | 2/2012 | Nazarian | H01F 17/0013 336/200 |
| 2013/0293336 | A1 | 11/2013 | Lo et al. | |
| 2013/0328164 | A1* | 12/2013 | Cheng | H01L 28/10 257/531 |

OTHER PUBLICATIONS

Bae, H., et al. "Cost Effective Parallel-branch Spiral Inductor with Enhanced Quality Factor and Resonance Frequency" 2007 Topical Meeting on Silicon Monolithic Integrated Circuits in RF Systems. Jan. 2007. pp. 87-90.

López-Villegas, J., et al. "Improvement of the Quality Factor of RF Integrated Inductors by Layout Optimization" IEEE Transactions on Microwave Theory and Techniques, vol. 48, No. 1. Jan. 2000. pp. 76-83.

Tiemeijer, L.F., et al. "Record Q Spiral Inductors in Standard CMOS" International Electron Devices Meeting, 2001. IEDM '01. Technical Digest. Dec. 2001. pp. 40.7-1-40.7-3.

Wu, C., et al. "Selective Metal Parallel Shunting Inductor and Its VCO Application" IEEE Transactions on Circuits and Systems—I: Regular Papers, vol. 52, No. 9. Sep. 2005. pp. 1811-1818.

Xu, X., et al. "Design of Novel High-Q-Factor Multipath Stacked On-Chip Spiral Inductors" IEEE Transactions on Electron Devices, vol. 59, No. 8. Aug. 2012. pp. 2011-2018.

Yin, W., et al. "Double-Level Spiral Inductors With Multiple-Via Interconnects on GaAs Substrates" IEEE Transactions on Magnetics, vol. 40, No. 3. May 2004. pp. 1756-1758.

* cited by examiner

3D MULTIPATH INDUCTOR

BACKGROUND

Technical Field

The present invention relates to integrated circuits, and more particularly to three-dimensional integrated circuit inductor structures configured with lateral and/or vertical equal path length architectures.

Description of the Related Art

With an increased demand for personal mobile communications, integrated semiconductor devices such as complementary metal oxide semiconductor (CMOS) devices may, for example, include voltage controlled oscillators (VCO), low noise amplifiers (LNA), tuned radio receiver circuits, or power amplifiers (PA). Each of these tuned radio receiver circuits, VCO, LNA, and PA circuits may, however, require on-chip inductor components in their circuit designs.

Several design considerations associated with forming on-chip inductor components may, for example, include quality factor (i.e., Q-factor), self-resonance frequency ($f_{SR}$), and cost considerations impacted by the area occupied by the formed on-chip inductor. Accordingly, for example, a 7CMOS radio frequency (RF) circuit design may benefit from, among other things, one or more on-chip inductors having a high Q-factor, a small occupied chip area, and a high $f_{SR}$ value. The $f_{SR}$ of an inductor may be given by the following equation:

$$f_{SR} = \frac{1}{2\pi\sqrt{LC}},$$

where L is the inductance value of the inductor and C may be the capacitance value associated with the inductor coil's inter-winding capacitance, the inductor coil's interlayer capacitance, and the inductor coil's ground plane (i.e., chip substrate) to coil capacitance. From the above relationship, a reduction in capacitance C may desirably increase the $f_{SR}$ of an inductor. One method of reducing the coil's ground plane to coil capacitance (i.e., metal to substrate capacitance) and, therefore, C value, is by using a high-resistivity semiconductor substrate such as a silicon-on-insulator (SOI) substrate. By having a high resistivity substrate (e.g., >50 Ω-cm), the effect of the coil's metal (i.e., coil tracks) to substrate capacitance is diminished, which in turn may increase the $f_{SR}$ of the inductor. Reducing the inductor coil's inter-winding and interlayer capacitance can similarly increase the $f_{SR}$ of the inductor.

The Q-factor of an inductor at frequencies well below $f_{SR}$ may be given by the equation:

$$Q = \frac{\omega L}{R},$$

where ω is the angular frequency, L is the inductance value of the inductor, and R is the resistance of the coil. As deduced from the above relationship, a reduction in coil resistance may lead to a desirable increase in the inductor's Q-factor. For example, in an on-chip inductor, by increasing the turn-width (i.e., coil track width) of the coil, R may be reduced in favor of increasing the inductors Q-factor to a desired value. In radio communication applications, the Q-factor value is set to the operating frequency of the communication circuit. For example, if a radio receiver is required to operate at 2 GHz, the performance of the receiver circuit may be optimized by designing the inductor to have a peak Q frequency value of about 2 GHz. The $f_{SR}$ and Q-factor of an inductor are directly related in the sense that by increasing $f_{SR}$, peak Q is also increased.

Skin effect is the tendency for high-frequency currents to flow on the surface of a conductor. Proximity effect is the tendency for current to flow in other undesirable patterns, e.g., loops or concentrated distributions, due to the presence of magnetic fields generated by nearby conductors. In transformers and inductors, proximity effect losses typically dominate over skin effect losses. Proximity and skin effects significantly complicate the design of efficient transformers and inductors operating at high frequencies.

In radio frequency tuned circuits used in radio equipment, proximity and skin effect losses in the inductor reduce the Q factor. To minimize this, special construction is used in radio frequency inductors. The winding is usually limited to a single layer, and often the turns are spaced apart to separate the conductors. In multilayer coils, the successive layers are wound in a crisscross pattern to avoid having wires lying parallel to one another.

SUMMARY

A three-dimensional multipath inductor includes a plurality of turns disposed about a center region on at least two layers, the turns on the at least two layers having corresponding geometry therebetween. Each of the plurality of turns is comprised of two or more segments that extend length-wise along the turns, and the segments have positions that vary from an innermost position relative to the center region and an outermost position relative to the center region. A lateral cross-over is configured to couple the segments of at least one turn on one layer with the segments on a turn on a same layer to form segment paths that have a substantially same length for all segment paths in a grouping of segment paths on that same layer. A vertical cross-over is configured to couple the segments on different vertically stacked metal layers to have the segment groups with a substantially same length for all segment paths based on vertical lengths.

Another three-dimensional multipath inductor includes a plurality of turns disposed about a center region on at least two layers, the turns on the at least two layers having corresponding geometry therebetween. Each of the plurality of turns is comprised of two or more segments that extend length-wise along the turns, the segments having positions that vary from an innermost position relative to the center region and an outermost position relative to the center region. At least one vertical cross-over is configured to couple the segments on different vertically stacked metal layers to have the segment groups with a substantially same length for all segment paths based on vertical lengths. At least one lateral cross-over is configured to couple the segments of at least one turn on one layer with the segments on a turn on a same layer to form segment paths that have a substantially same length for all segment paths in a grouping of segment paths on that same layer. At least one connection between lateral segments connects two or more segments in parallel on an inner side of the inductor to form a composite segment with increased conductive area.

A method for fabricating a three-dimensional multipath inductor includes forming a first metal layer to form spiral turns about a center region, the spiral turns including two or more segments that extend length-wise along the turns and having positions that vary from an innermost position relative to the center portion and an outermost position relative to the center portion; forming at least one lateral cross-over configured to couple portions of lateral segments in different relative positions from the center portion to form lateral segment paths that have a substantially same length for all segment paths in a grouping of segments; forming one or more additional metal layers to form spiral turns about the center region including corresponding geometry to the first metal layer; and forming at least one vertical cross-over configured to couple portions of vertical segments on different metal layers to form vertical segment paths that have a substantially same length for all segment paths in a grouping of segments.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

Figure 1:
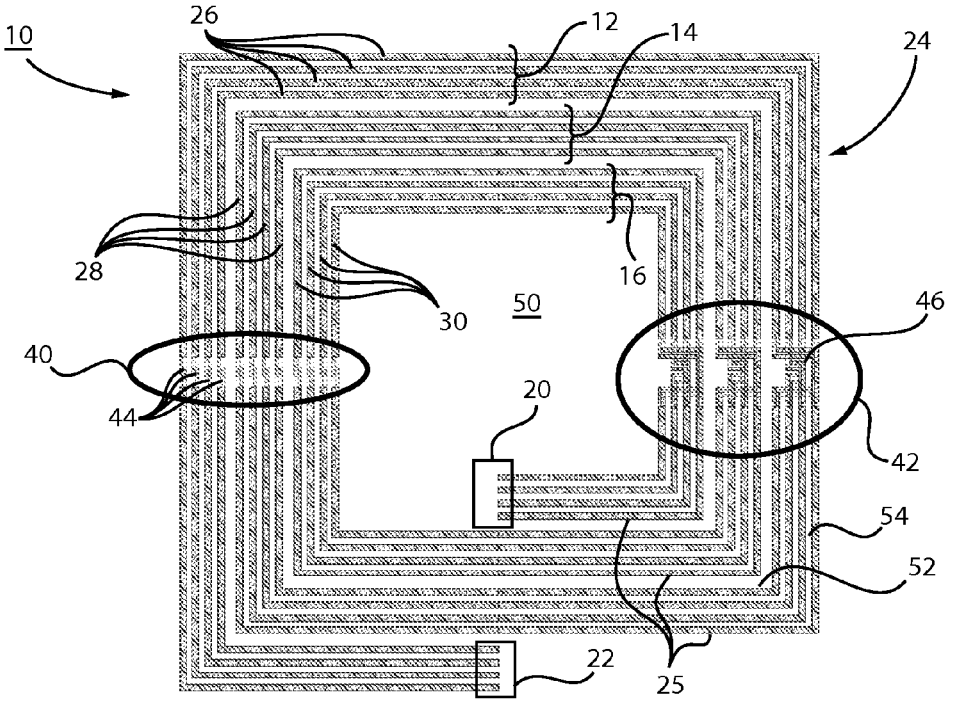
FIG. 1 is a layout view of an illustrative parallel stacked multipath inductor in accordance with the present principles.

In accordance with the present principles, structures and methods for forming these structures are disclosed for three-dimensional (3D) inductors. The 3D inductors are preferably included on or with integrated circuits and more specifically may be formed on or in semiconductor devices. In particularly useful embodiments, the 3D inductors are employed in high speed applications, such as on or in radiofrequency (RF) devices and the like. In one embodiment, a 3D inductor structure includes two or more metal layers formed in spirals and includes adjustment areas at positions in the spirals. The adjustment areas provide both lateral (in a direction across the spiral) and vertical (in direction of stacking of the metal layers) path length equality between paired portions. It is beneficial to switch currents across the layers vertically as well as laterally to further reduce current crowding effects.

The spirals are electrically connected using multiple vias at the adjustment areas. The adjustment areas include lateral cross-over locations for lateral adjustment and vertical cross-over locations for vertical adjustment. Note that adjustment areas, whether lateral cross-over locations or vertical cross-over locations may employ lateral shifts in lines or segments and/or via connections between metal layers. Each spiral is divided into multiple segments. In some embodiments, the number and or size of segments may be reduced from outer turn to inner turn. The structures in accordance with the present principles can provide variability in a number of segments, turn width, space throughout the spiral length and other geometric variations.

The spirals employ an adjustment area architecture, occurring one or more times per turn, to equalize the current flow through each segment. This is achieved by ensuring that the length of combined segments on different levels have a same overall length. The adjustment area architecture is employed on multiple metal levels to enable lateral and vertical connections of segments without shorting segments together. Inductor structures for reduced skin and proximity effect losses are provided in accordance with the present principles. The inductor structures in accordance with the present principles include a multi layered parallel stacked winding for reduced resistance where spiral turns are divided into multiple strands or segments and interlevel cross-overs are provided to steer the current in such a way that all the path lengths are made equal to reduce skin and proximity effect losses. Moreover, the nature of the winding permits variable width and spacing for both the turns and segments, which further reduces the proximity effect losses.

The structures described herein may be employed with other structures, such as patterned ground shields, magnetic materials, etc.

It is to be understood that the present invention will be described in terms of a given illustrative architecture implemented on semiconductor substrates; however, other architectures, structures, substrate materials and process features and steps may be varied within the scope of the present invention. For example, the multipath architecture described for two layers can be extended to three or more layers for reduced resistance. The terms coils, inductors and windings may be employed interchangeably throughout the disclosure. It should also be understood that these structures may take on any useful shape including rectangular, circular, oval, square, polygonal, etc.

It will also be understood that when an element such as a layer, region or substrate is referred to as being "on" or "over" another element, it can be directly on the other element or intervening elements may also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

A design for an integrated circuit chip in accordance with the present principles may be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer may transmit the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

Methods as described herein may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multichip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This may be extended, as readily apparent by one of ordinary skill in this and related arts, for as many items listed.

Referring now to the drawings in which like numerals represent the same or similar elements (except where noted) and initially to FIG. 1, a three-dimensional (3D) parallel stacked multipath inductor 10 is illustratively shown having two or more levels (metal layers) stacked into or out of the page. The 3D multi-layer parallel stacked inductor 10 includes a structure with one or more turns 12, 14, 16 and with outer 22 and inner 20 connections, one at each end of a spiral 24. The spiral turns 12, 14, 16 are divided laterally into segment groups 26, 28, 30, respectively, and vertically into segments (vertical segments including one or more parallel stacked metal layers) (described below). The number of segments of the lateral segments groups (26, 28, 30) may be reduced from the outer turn 12 to the inner turn 16. FIG. 1 shows the size of the turns being reduced, but the number of segments (or strands) 25 remaining the same (4 segments for all turns). To reduce the number of segments 25, two of the outer segments maybe be connected to a same inner segment.

At a distance along each turn 12, 14, 16, preferably half way or at a position of equal distance before and after, a vertical cross-over location 40 is provided to cross-connect vertical segments 44 in each lateral segment group 26, 28, 30 so that the segments in each group 26, 28 and 30 are translated vertically to ensure equal path length in the vertical direction. At an inner end of each turn 12, 14, 16 or other location, e.g., half way or at a position of equal distance before and after, the lateral segment groups 26, 28, 30 are translated laterally by a lateral cross-over 46 at a lateral cross-over location 42 to ensure equal path length in the lateral direction.

In one embodiment, the lateral number of segments may be reduced at the innermost turns of the spiral 10. This may include the innermost two or more lateral segments on each metal layer may be connected together in parallel. This reduces the number of lateral segments by one or more for the next inner spiral turn. For example, turn 12 may include four segments in a segment group 26, turn 14 may include three segments in a segment group 28 and turn 16 may include two segments in a segment group 30. Laterally and vertically adjacent segments are connected in parallel at the outer 22 and inner 20 spiral connections. This structure provides at least: a higher quality factor and reduced inductance roll off with frequency.

Other variations in spiral 10 may include reducing a width or a diameter of the conductor that makes up the segments 25. The reduced width or diameter may be reduced at a constant rate or any other monotonic rate (including periodically constant) while winding toward a center 50 of the coil 10. Spaces 52 between each consecutive turn may be increased at a constant rate or any other monotonic rate (including periodically constant) while winding toward the center 50 of the coil 10. A width or diameter of each segment group 26, 28, 30 may be reduced at a constant rate or any other monotonic rate (including periodically constant) while winding toward the center 50 of the coil 10. A space 54 between segments 25 in each consecutive turn may be increased at a constant rate or any other monotonic rate (including periodically constant) while winding toward the center 50 of the coil 10. A number of vias or metal volume connecting across the turns in parallel could be varied for highest performance at a given frequency. Each of these and other variations can be employed to achieve high performance requirements of many applications in accordance with the present principles.

Figure 2:
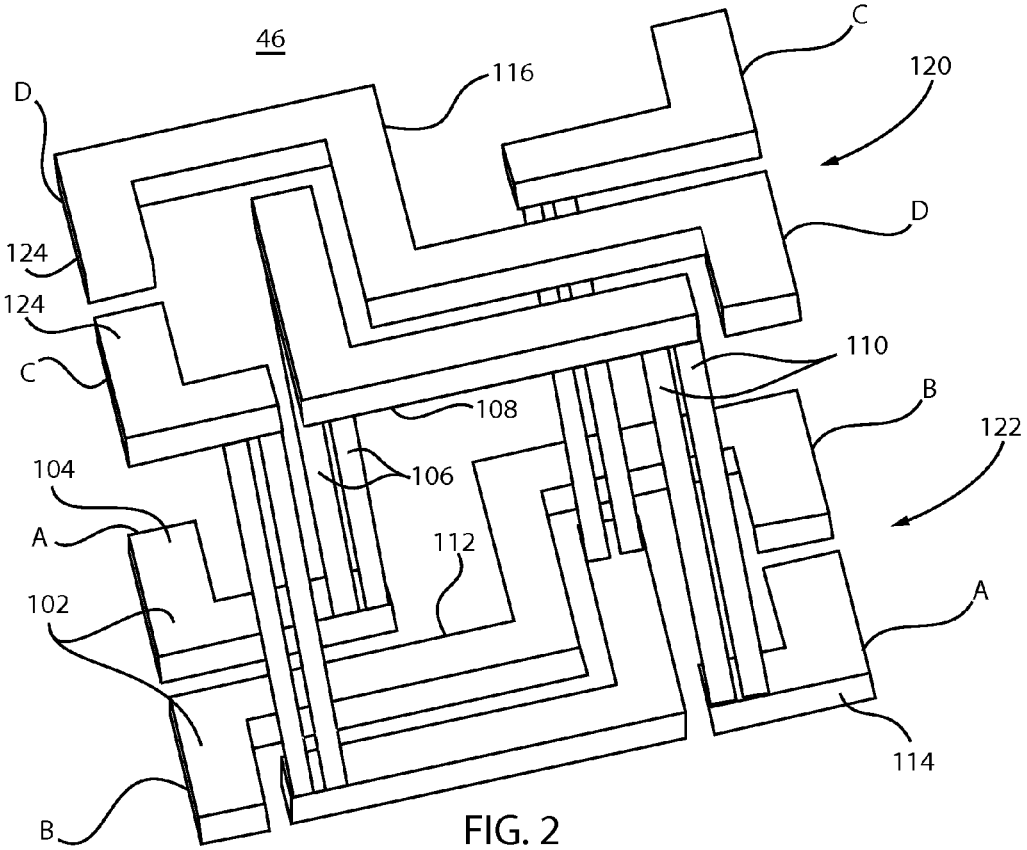
FIG. 2 is a perspective view of a lateral cross-over showing segment connections for turns with two segments in accordance with the present principles.

Referring to FIG. 2, a lateral cross-over 46 is shown in greater detail for two metal layers 120 and 122 respectively having segment pairs or groups 124 and 102 formed therein. In accordance with the present principles, the segments pairs switch positions in the lateral cross-over region 46. The positions are switched within a same metal layer (120 or 122). For example, following a segment path A and beginning with a portion 104 on metal layer 122, a via or vias 106 connect to a bridge portion 108 on metal layer 120 and then to via or vias 110 connecting to portion 114. Path A has its position switched from an inside (or outside) position on a turn to an outside (or inside) position on the same turn and within the same metal layer (122). Path B, which includes the other path of segment pair (group) 102, has a direct connection 112 in metal layer 122. Similarly for segment pair (group) 124, path D is a direct connection 116 and path C moves between metal layer 120 to metal layer 122 and back again. The positions of path C and D are laterally transposed in a same metal layer (120) as are paths A and B in metal layer 122.

Figure 3:
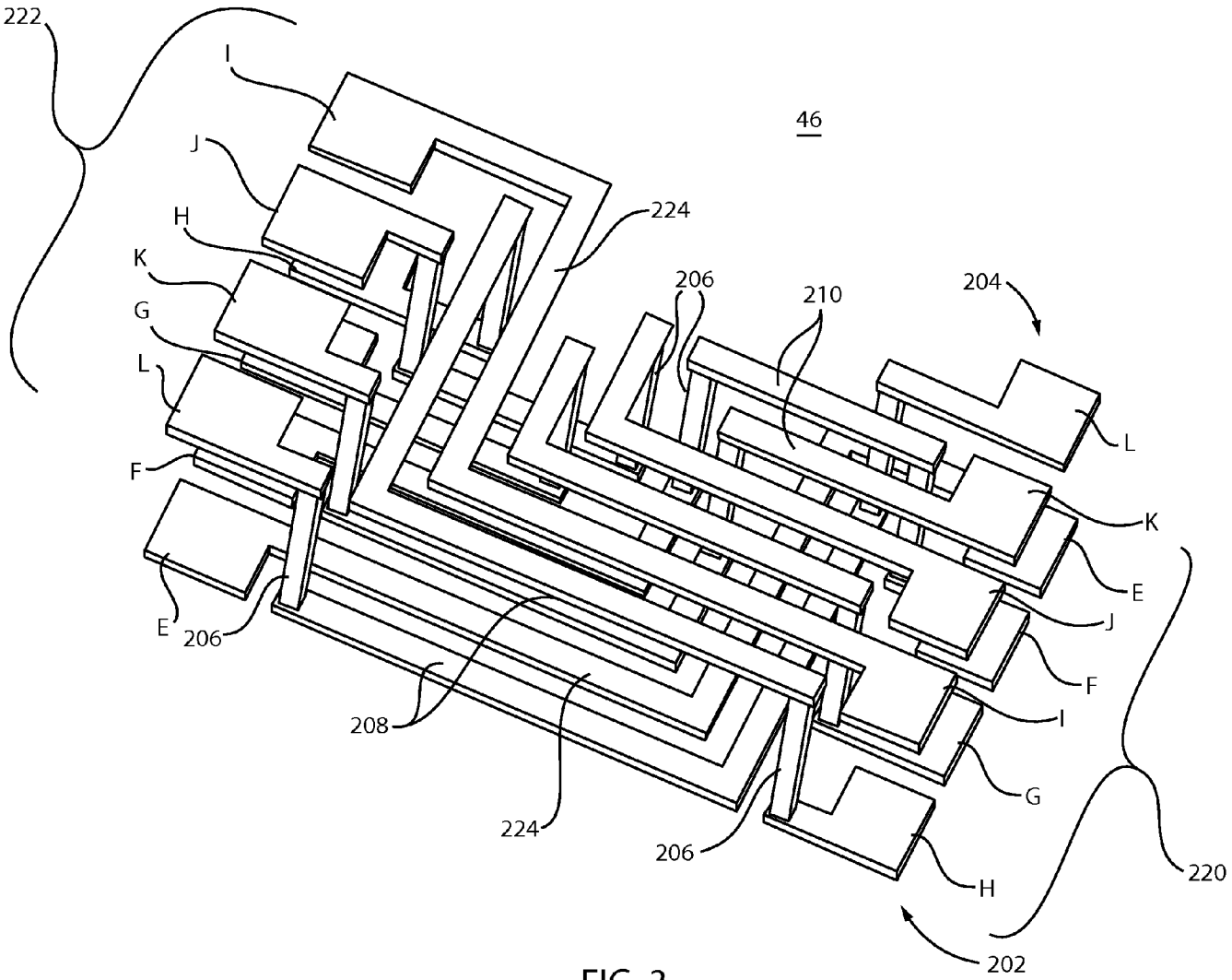
FIG. 3 is a perspective view of a lateral cross-over showing segment connections for turns with four segments in accordance with the present principles.

Referring to FIG. 3, a lateral cross-over 46 is shown in greater detail for two metal layers 202 and 204 respectively having segment groups 220 and 222 formed therein. The segments groups 220 and 222 each include four segments. Segment paths E, F, G, and H transpose positions on metal layer 202. Segment paths I, J, K and L transpose positions on metal layer 204. Each segment path includes vias 206 connecting a conductor 208 on a different metal layer and returning by a via connection (206) to the original metal layer. Where possible, a conductor 224 may be patterned on a same metal layer. In accordance with the present principles, the segment groups switch positions in the lateral cross-over region 46 such that an outer segment becomes an inner segment and vice versa for that metal layer. Intermediary segments (F, G, J, K) also relatively switch from an intermediary outer segment to an intermediary inner segment and vice versa for that metal layer.

Figure 4:
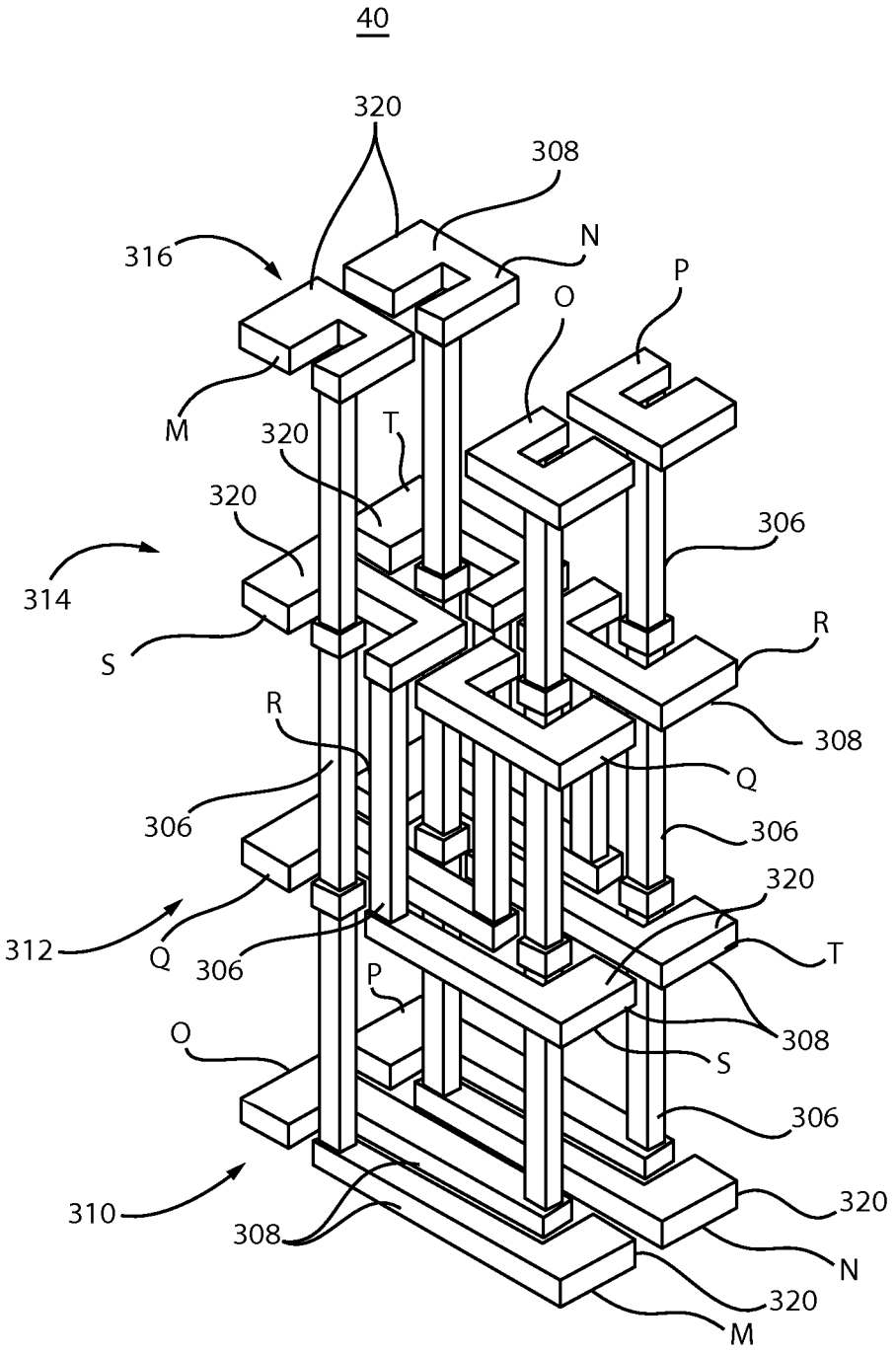
FIG. 4 is a perspective view of a vertical cross-over showing segment connections for turns with two segments in accordance with the present principles.

Referring to FIG. 4, a vertical cross-over 44 is shown in greater detail for four metal layers 310, 312, 314, and 316. The vertical cross-over 44 connects different vertical layers (segments on different metal layers). The vertical cross-over 44 connects a lowest layer to a highest layer (and vice versa) for top and bottom segment groups. The vertical cross-over 44 connects intermediary metal layers to their respective metal layer counterparts. In this way, vertical path lengths are equated. For the vertical cross-over 44, paths M, N, O and P connect through metal layers 310, 312, 314 and 316 using vias 306. Lateral conductors 308 may be employed to provide positioning for the vias 306. Paths M, N, O and P connect a lowest layer 310 to a highest layer 312 (or vice versa) for a top and bottom segment group. Paths Q, R, S and T connect an intermediary layer 312 to intermediary layer 314 (or vice versa) for intermediary segment groups. Each metal layer 310, 312, 314 and 316 has a segment pair 320 disposed therein, e.g., 2 segments per layer. The vertical cross-over 44 connects different layers without lateral cross-over. In other words, the inside segments remain inside and the outside segments remain outside.

Figure 5:
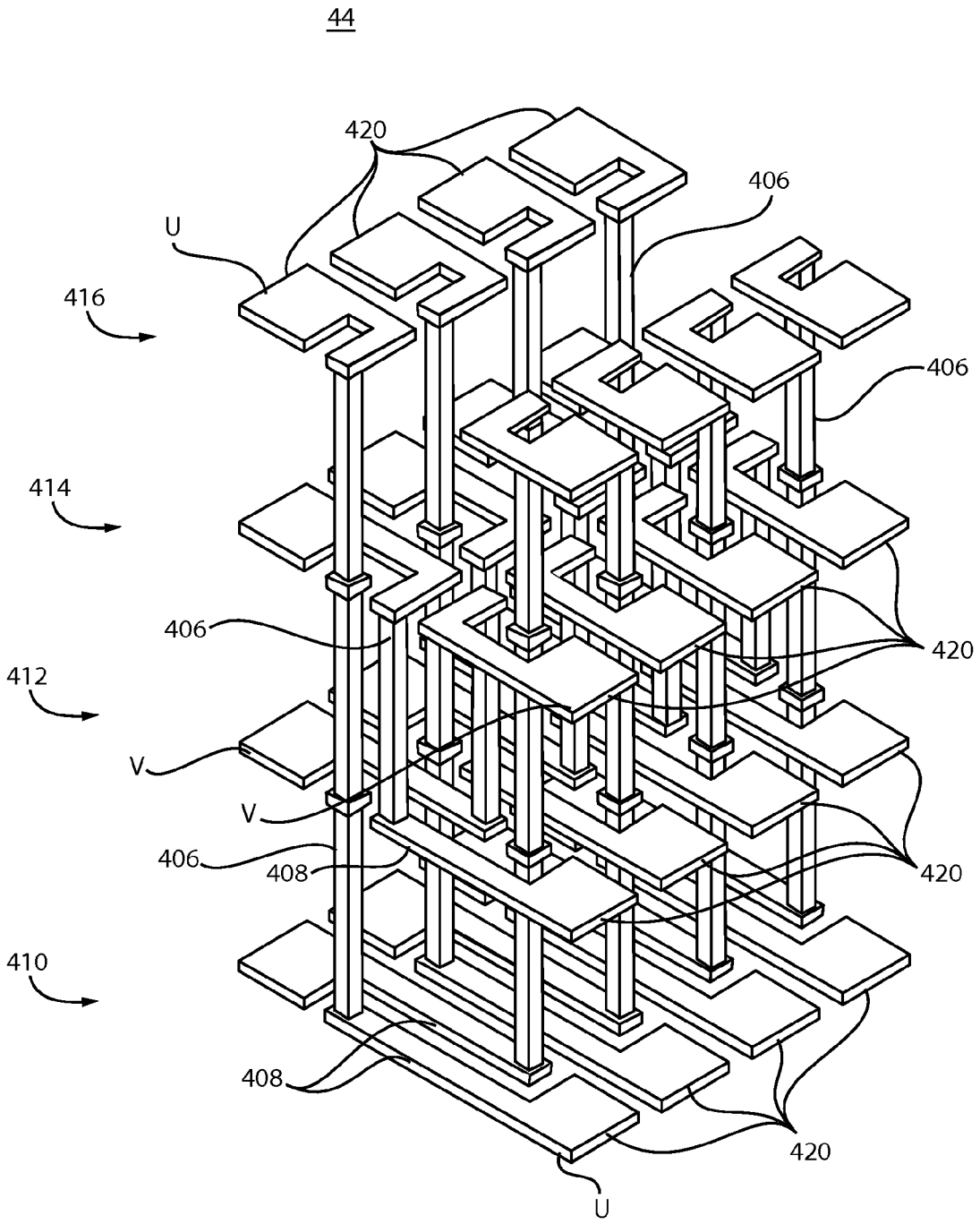
FIG. 5 is a perspective view of a vertical cross-over showing segment connections for turns with four segments in accordance with the present principles.

Referring to FIG. 5, a vertical cross-over 44 is shown in greater detail for four metal layers 410, 412, 414, and 416. The vertical cross-over 44 connects different vertical layers (segments on different metal layers). The vertical cross-over 44 connects a lowest layer to a highest layer (and vice versa) for top and bottom segment groups. The vertical cross-over 44 connects intermediary metal layers to their respective metal layer counterparts. In this way, vertical path lengths are equalized. For the vertical cross-over 44, path U illustratively connects through metal layers 410, 412, 414 and 416 using vias 406. Lateral conductors 408 may be employed to provide positioning for the vias 406. Path U connects a lowest layer 410 to a highest layer 412 (or vice versa) for a top and bottom segment group. Path V illustratively connects an intermediary layer 412 to intermediary layer 414 (or vice versa) for intermediary segment groups. Each metal layer 410, 412, 414 and 416 has a segment group 420 disposed therein, e.g., 4 segments per layer. The vertical cross-over 44 connects different layers without lateral cross-over. In other words, the inside segments remain inside and the outside segments remain outside.

Figure 6:
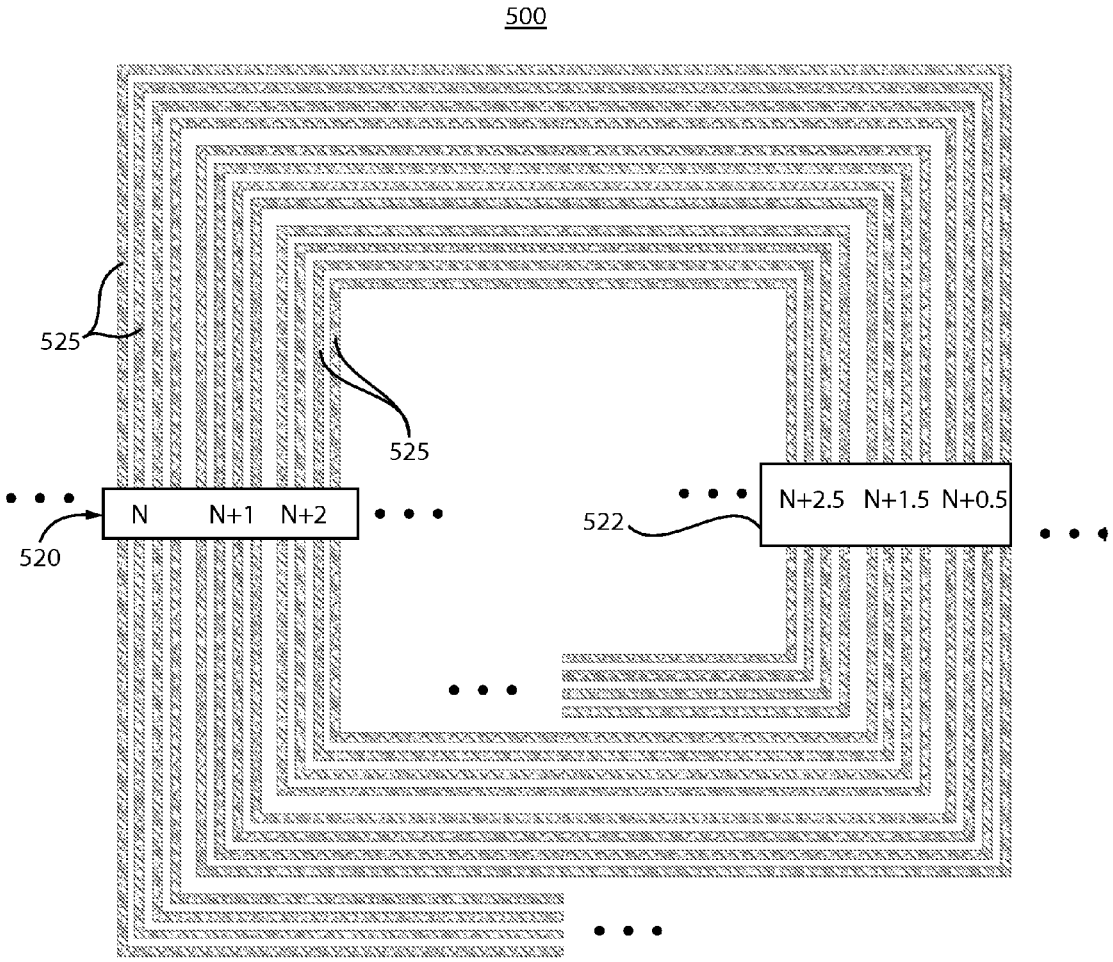
FIG. 6 is a plan view of an illustrative parallel stacked multipath inductor showing lateral and vertical cross-over regions ½ a turn apart in accordance with the present principles.

Referring to FIG. 6, a portion of a top view of a 3D parallel stacked multipath inductor 500 is illustratively shown having four levels (metal layers 510, 512, 514, 516 (FIG. 7)) stacked (not shown) into or out of the page. The inductor includes four lateral segments 525 in each turn (N, N+1, N+2, etc.). Region 520 includes lateral cross-over regions for each turn, N, N+1 and N+2. Region 522 includes vertical cross-over regions for each half turn, N+0.5, N+1.5 and N+2.5. Note that the inductor 500 may have a greater or lesser number of turns and that the description herein is illustrative.

Figure 7:
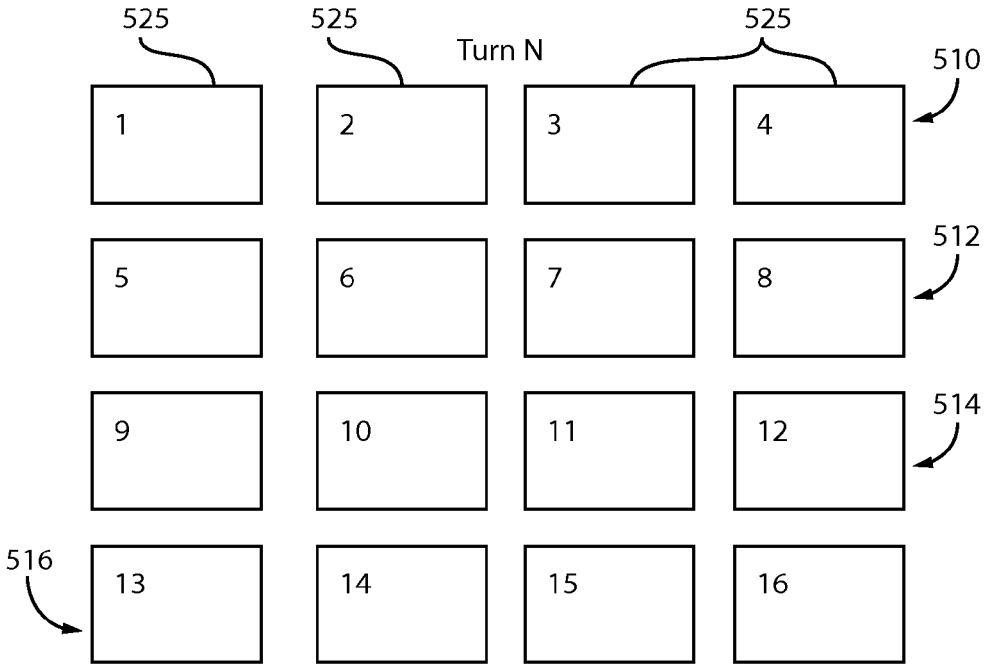
FIG. 7 is a cross-sectional view at turn N showing 16 segments in an original order in accordance with one embodiment.

Referring to FIG. 7, a cross-sectional view taken through region 520 at turn N is illustratively shown. The cross-section shows sixteen segments labeled 1-16 (these labels within the boxes are not to be confused with the same number find numerals in FIG. 1). The segments are disposed in four layers (metal layers 510, 512, 514 and 516) and have four segments laterally across to create a 4×4 structure.

Figure 8:
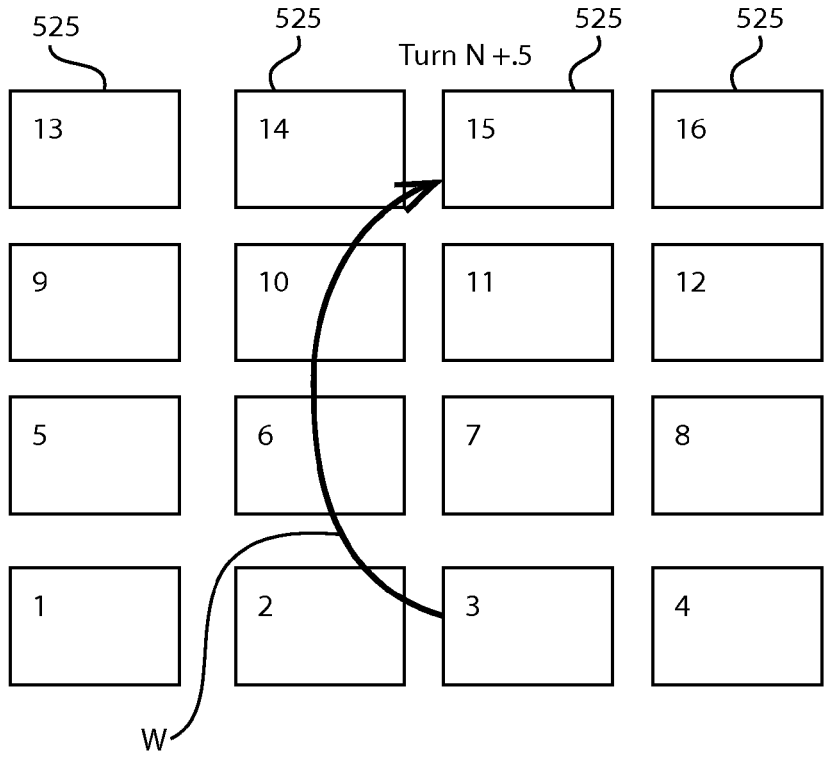
FIG. 8 is a cross-sectional view at turn N+0.5 showing 16 segments after a vertical transpose of the arrangement in FIG. 7 in accordance with one embodiment.

Referring to FIG. 8, a cross-sectional view taken through region 522 at turn N+0.5 is illustratively shown. The cross-section shows the sixteen segments labeled 1-16 after a vertical cross-over. Note the inside/outside lateral orientation remains the same but the vertical orientation is transposed (as indicated by arrow "W"). Paths for segments 13, 14, 15 and 16 are exchanged respectively with segments 1, 2, 3 and 4. Paths for segments 9, 10, 11 and 12 are exchanged respectively with segments 5, 6, 7 and 8.

Figure 9A:
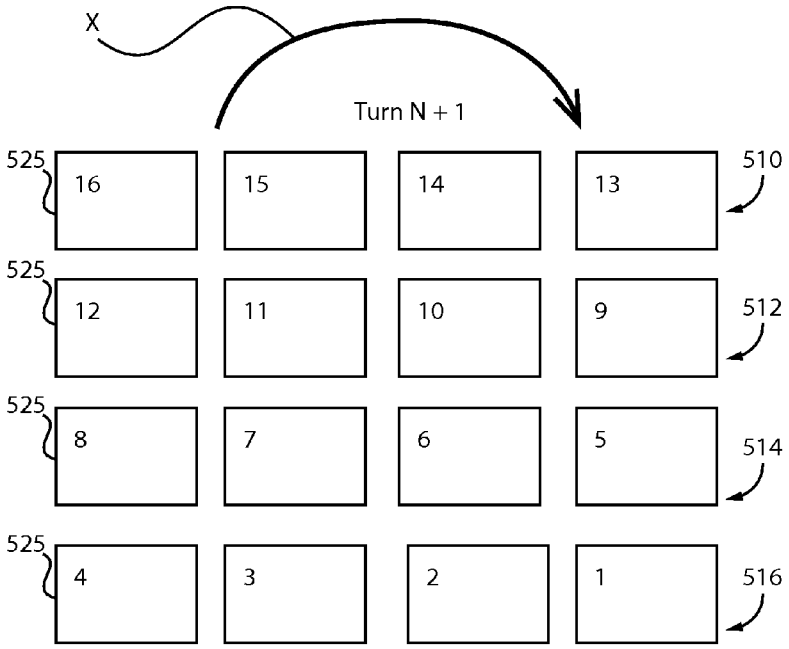
FIG. 9A is a cross-sectional view at turn N+1 showing 16 segments after a lateral transpose of the arrangement in FIG. 8 in accordance with one embodiment.

Referring to FIG. 9A, a cross-sectional view taken through region 520 at turn N+1 is illustratively shown. The cross-section shows the sixteen segments labeled 1-16 after a lateral cross-over. Note the segments are laterally transposed within each metal layer (510, 512, 514, 516). The paths for transposing the segments may include a direct path (same metal) or indirect path (vias and a different metal layer). Arrow "X" indicates a lateral cross-over. Paths for segments 13, 9, 5 and 1 are exchanged respectively with segments 16, 12, 8 and 4. Paths for segments 14, 10, 6 and 2 are exchanged respectively with segments 15, 11, 7 and 3.

In one embodiment, the lateral and vertical transposition can continue at each turn and half turn as set forth in FIGS. 8 and 9A. However, in other embodiments, the number of segments can be reduced by connecting the segments in parallel at the innermost segments as the coil winds. These segments can be connected in parallel by forming the conductive pads and vias that connect adjacent segments. The following FIGS. 9B-12 show vertical and lateral cross-overs where innermost segments are combined (connected in parallel) as the coil winds inwardly.

Figure 9B:
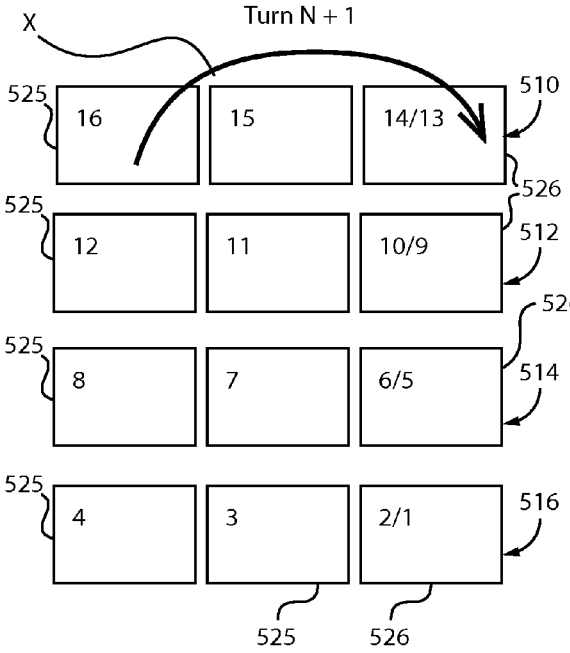
FIG. 9B is a cross-sectional view at turn N+1 showing 16 segments after combining two innermost segments and a lateral transpose of the arrangement in FIG. 8 in accordance with an alternate embodiment.

Referring to FIG. 9B, an alternate cross-sectional view taken through region 520 at turn N+1 is illustratively shown. The cross-section shows the sixteen segments labeled 1-16 after a lateral cross-over (arrow "X"). Note the segments are laterally transposed within each metal layer (510, 512, 514, 516). The paths for transposing the segments may include a direct path (same metal) or indirect path (vias and a different metal layer). Segments 14 and 13; 10 and 9; 6 and 5; 2 and 1 are connected in parallel to form composite segments 526 at an inside turn (at N+1). Paths for segments 14/13, 10/9, 6/5 and 2/1 are exchanged respectively with segments 16, 12, 8 and 4. Paths for segments 15, 11, 7 and 3 remain in their position since they are centrally located relative to the composite segments 14/13, 10/9, 6/5 and 2/1 and segments 16, 12, 8 and 4.

Figure 10:
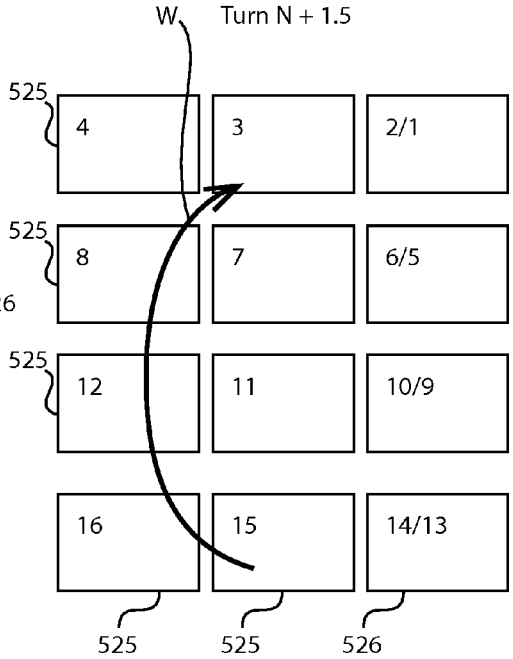
FIG. 10 is a cross-sectional view at turn N+1.5 showing 16 segments after a vertical transpose of the arrangement in FIG. 9B in accordance with one embodiment.

Referring to FIG. 10, continuing from FIG. 9B, a cross-sectional view taken through region 522 at turn N+1.5 is illustratively shown. The cross-section shows the sixteen segments labeled 1-16 after a vertical cross-over. Note the inside/outside lateral orientation remains the same, but the vertical orientation is transposed (as indicated by arrow "W"). Paths for segments 16, 15 and 14/13 are exchanged respectively with segments 4, 3 and 2/1. Paths for segments 12, 11 and 10/9 are exchanged respectively with segments 8, 7 and 6/5.

Figure 11:
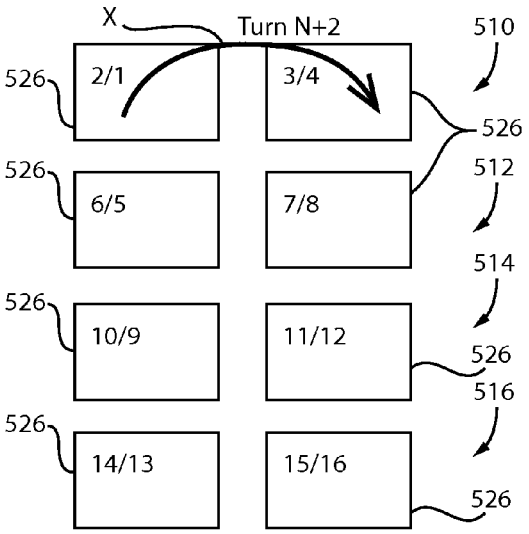
FIG. 11 is a cross-sectional view at turn N+2 showing 16 segments after combining two innermost segments and a lateral transpose of the arrangement in FIG. 10 in accordance with one embodiment.

Referring to FIG. 11, continuing from FIG. 10, a cross-sectional view taken through region 520 at turn N+2 is illustratively shown. The cross-section shows the sixteen segments labeled 1-16 after a lateral cross-over (arrow "X"). Note the segments are laterally transposed within each metal layer (510, 512, 514, 516). The paths for transposing the segments may include a direct path (same metal) or indirect path (vias and a different metal layer). Segments 3 and 4; 7 and 8; 11 and 12; 15 and 16 are connected in parallel to form composite segments 526 at an inside turn (at N+1). Paths for segments 3/4, 7/8, 11/12 and 15/16 are exchanged respectively with composite segments 2/1, 6/5, 10/9 and 14/13.

Figure 12:
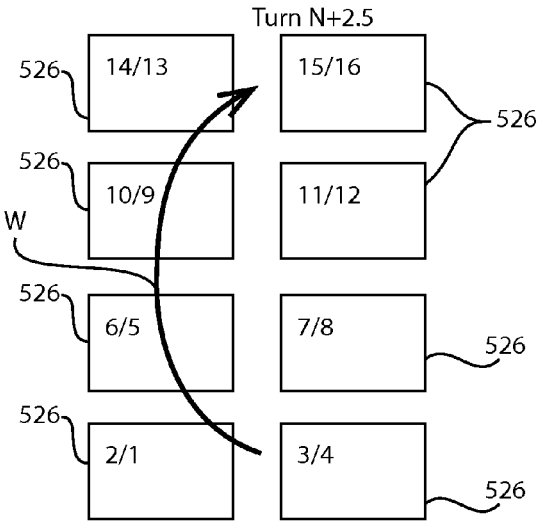
FIG. 12 is a cross-sectional view at turn N+2.5 showing 16 segments after a vertical transpose of the arrangement in FIG. 11 in accordance with one embodiment.

Referring to FIG. 12, continuing from FIG. 11, a cross-sectional view taken through region 522 at turn N+2.5 is illustratively shown. The cross-section shows the sixteen segments labeled 1-16 after a vertical cross-over. Note the inside/outside lateral orientation remains the same but the vertical orientation is transposed (as indicated by arrow "W"). Paths for segments 14/13 and 15/16 are exchanged respectively with segments 2/1 and 3/4. Paths for segments 10/9 and 11/12 are exchanged respectively with segments 6/5 and 7/8.

Figure 13:
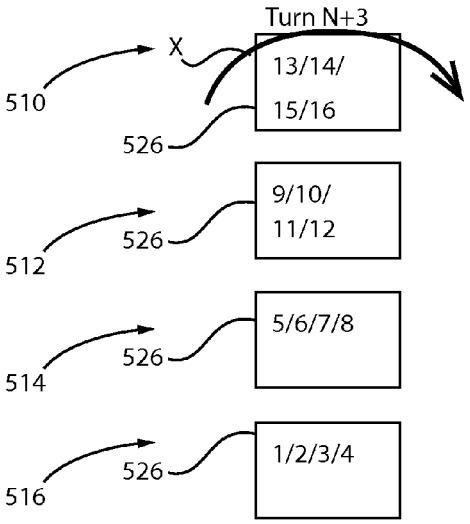
FIG. 13 is a cross-sectional view at turn N+3 showing 16 segments after combining two innermost segments and a lateral transpose of the arrangement in FIG. 12 in accordance with one embodiment.

Referring to FIG. 13, continuing from FIG. 12, a cross-sectional view taken through region 520 at turn N+3 is illustratively shown. The cross-section shows the sixteen segments labeled 1-16 after a lateral cross-over (arrow "X"). Note the segments are laterally transposed within each metal layer (510, 512, 514, 516). The paths for transposing the segments may include a direct path (same metal) or indirect path (vias and a different metal layer). Since the inductor 500 includes four segments across each turn, at turn 3 all segments have been connected in parallel. It should be understood that the number of segments may be varied, or the number of segments compositely combined in parallel may be varied as well. For example, an innermost segment may be combined on every other turn, etc. FIG. 13 shows all segments laterally combined by connecting the segments in parallel. Metal layer 510 includes composite segment 13/14/15/16; metal layer 512 includes composite segment 9/10/11/12; metal layer 514 includes composite segment 5/6/7/8 and metal layer 516 includes composite segment 1/2/3/4. These segments are laterally connected in parallel to form composite segments 526.

Figure 14:
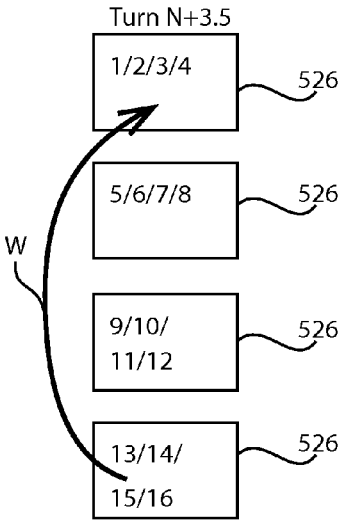
FIG. 14 is a cross-sectional view at turn N+3.5 showing 16 segments after a vertical transpose of the arrangement in FIG. 13 in accordance with one embodiment.

Referring to FIG. 14, continuing from FIG. 13, a cross-sectional view taken through region 522 at turn N+3.5 is illustratively shown. The cross-section shows the sixteen segments labeled 1-16 after a vertical cross-over. The vertical orientation is transposed (as indicated by arrow "W"). Paths for segments 1/2/3/4 are exchanged respectively with segments 13/14/15/16. Paths for segments 5/6/7/8 are exchanged respectively with segments 9/10/11/12.

Figure 15:
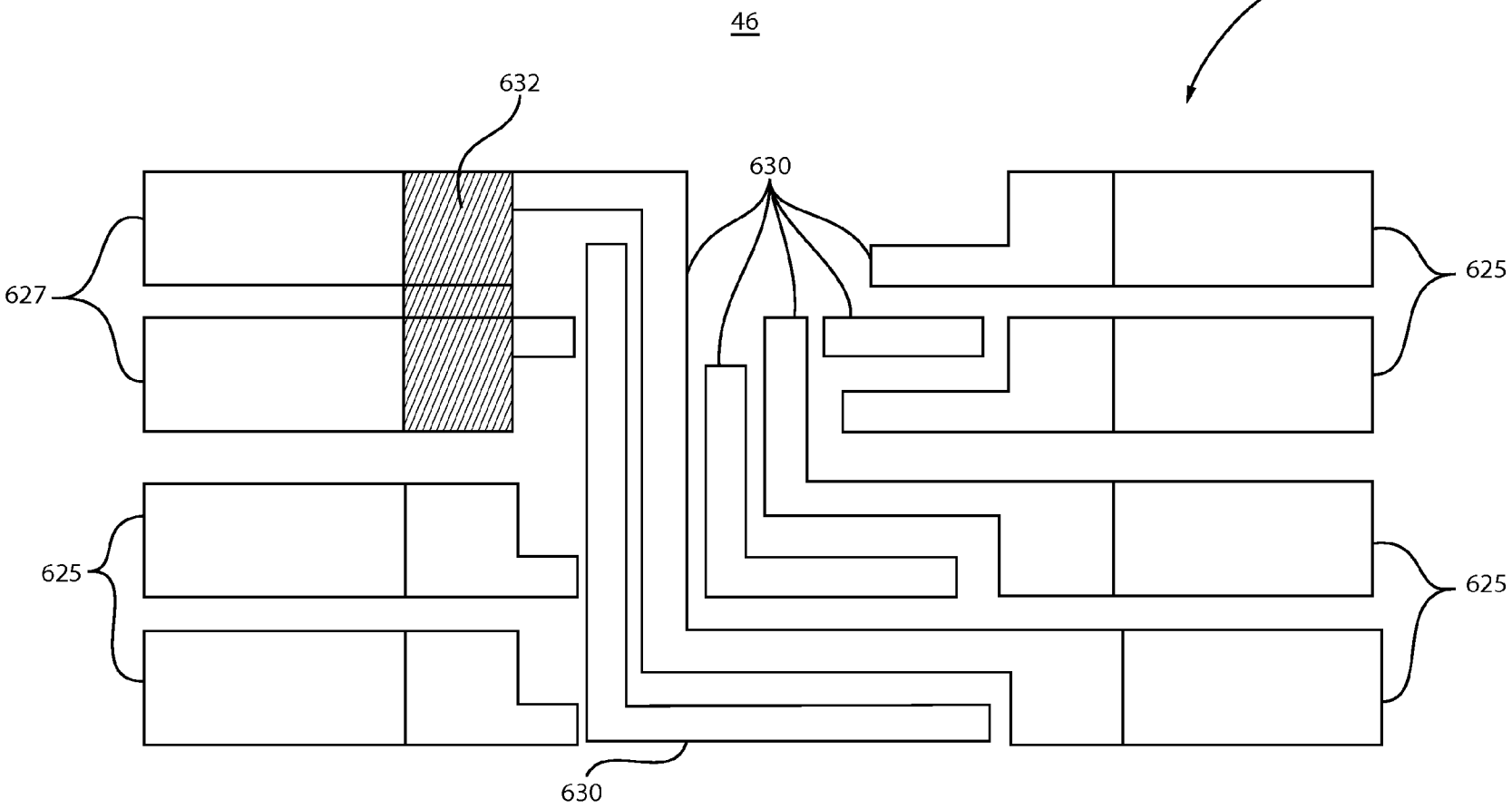
FIG. 15 is a plan view of a lateral cross-over with four segments showing a parallel segment connection to connect two segments in accordance with the present principles.

Referring to FIG. 15, a plan view of the lateral cross-over 46 is shown in greater detail for one metal layer 610 having segments 625 (four) of a segment group. The metal layer 610 is patterned to connect in parallel two adjacent segments using a conductor 632, which is preferably on metal layer 610. These connected segments 627 may also be connected at an opposite end on a next turn as well (not shown) such that the connected segments 627 act as a single, larger segment formed by connecting the segments at their ends. These connections are made in accordance with, e.g., the composite segments, as described with respect to FIG. 9B-14. Also depicted are conductors 630 which can be employed to laterally cross-over connections of segments. (See also FIG. 3, showing two metal layers and via connection therebetween). While FIG. 15 depicts one structure for connecting adjacent segments, other conductors and connection arrangements are also contemplated. For example, connections can be made through other metal layers using vias, or non-adjacent segments may be connected.

Figure 16:
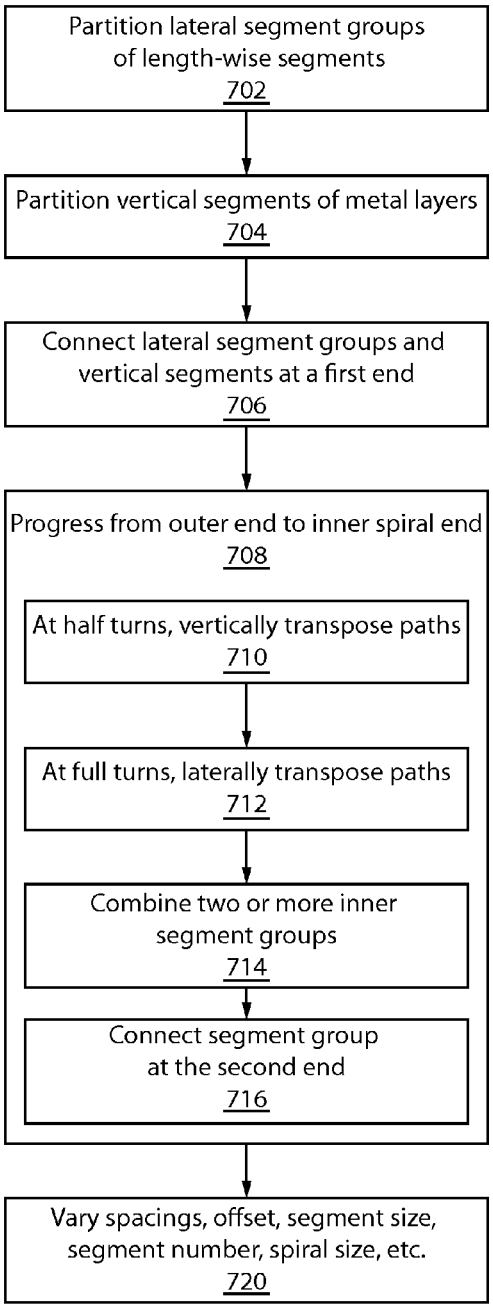
FIG. 16 is a block/flow diagram showing a method for designing a parallel stacked multipath inductor in accordance with illustrative embodiments.

Referring to FIG. 16, a block/flow diagram shows a design method for manufacturing an inductor structure with joining an innermost segment in parallel with each turn in accordance with one illustrative embodiment. The design method may be implemented in software.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

In block 702, multiple vertically adjacent spiral turn layers are partitioned laterally into lateral segment groups, each group including a set of vertically adjacent metal layers. The examples described above included a single metal layer for each level of the inductor; however, each level of the inductor may include multiple layers of metal stacked and connected by vias. These multiple levels can be combined to form larger segments arranged laterally but extending vertically into multiple metal layer. In block 704, each lateral segment group is partitioned into multiple vertical segments, each segment including one or more parallel stacked metal layers.

In block 706, all lateral segment groups and vertical segments are connected together within each group at a spiral outer connection (first end). In block 708, beginning at the outer spiral connection progress toward an inner spiral end (second end) and perform the following:

In block 710, if turn is integer (N)+½ turn (where N=0, 1, 2 . . . ), then vertically transpose paths of the segments within each lateral segment group. In block 712, if turn is an integer (N), laterally transpose segment groups (horizontally). These positions for vertical and lateral transposing may be reversed (N versus N+½). In block 714, combine two or more inner segment groups into one segment group with the same width as one combined or composite segment group(s). In block 716, at the inner spiral end (second end), connect together all lateral segment groups and vertical segments.

In block 720, vary spacings, segments sizes, number of segments, number of metal layers, via sizes and locations, number of turns, etc. to obtain desired performance. The design may be tested to measure performance using computer simulations or the like.

In accordance with the present principles, a 3D inductor structure is described that includes parallel stacking which provides for lower DC resistance. In simulation results, for a four segment structure with 3 micron thick metal layers, where the inductor had an area of 500×500 microns at an operating frequency of 500 MHz, the DC resistance was shown to be reduced by about 22% or more over a conventional solid conductor. The multipath architecture with cross-overs for equal path length both laterally and vertically reduced skin effect and proximity effect losses. Variable segments within each turn further reduced proximity effect losses. The inductance was 10% or greater than the conventional solid inductor. The disclosed structure achieved higher Q at lower frequencies (e.g., for Buck Regulators, CDMA) and was 40% higher at 500 MHz. Q>20 below 500 MHz with air core inductors.

The structures in accordance with the present principles provide a high inductance density, higher quality factor, higher self-resonance frequency and measured results support significant improvements in inductor performance. The 3D inductor structure in accordance with the present principles provides a winding that provides higher self-resonance frequency, includes a multipath architecture with lateral and vertical cross-overs for equal path length to reduce skin effect and proximity effect losses and includes variable segments within each turn (segment pairs) to further reduce proximity effect losses. Structures in accordance with the present principles may be implemented with all back end of the line (BEOL) processing options. The inductor structures may be employed in any semiconductor device or chip that includes or needs an inductor and, in particularly useful embodiments, the present principles provide inductors for high frequency applications such as communications applications, e.g., in GSM and CDMA frequency bands, amplifiers, power transfer devices, etc.

Figure 17:
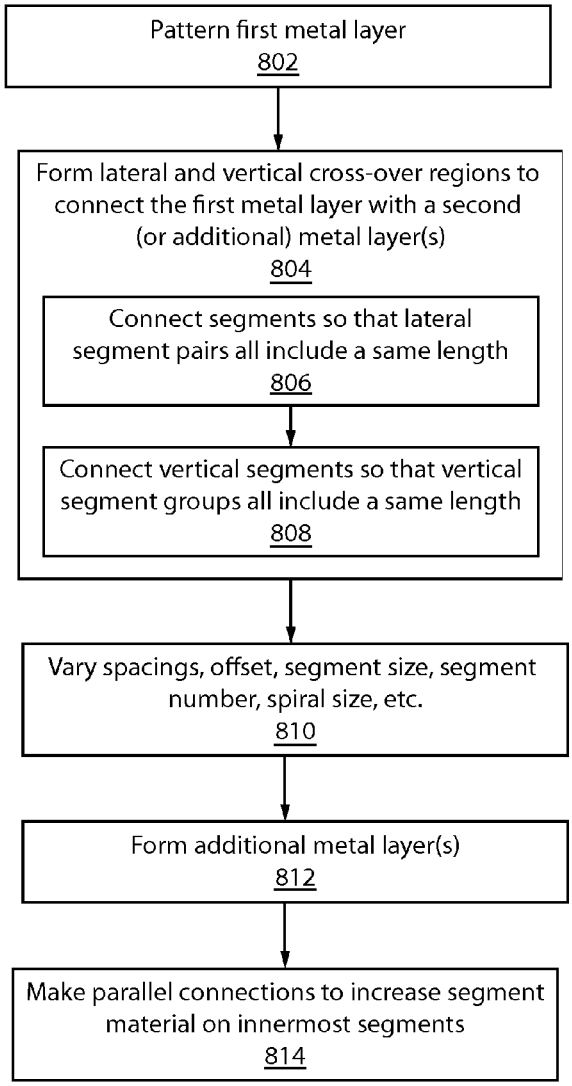
FIG. 17 is a block/flow diagram showing a method for fabricating a parallel stacked multipath inductor in accordance with illustrative embodiments.

Referring to FIG. 17, a method for fabricating a parallel stacked multipath inductor is shown in accordance with illustrative embodiments. It should be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In block 802, a first metal layer is patterned to form spiral turns about a center region. The patterning process may employ any known process including lithographic masking and etching, lithographic trench formation, metal deposition and chemical mechanical planarization, etc. The spiral turns include two or more segments that extend length-wise along the turns and have positions that vary from an innermost position relative to the center portion and an outermost position relative to the center portion.

In block 804, lateral and vertical cross-over architectures and any other connection paths between metal layers are formed and configured to couple the segments between the first layer to the segments of a second layer (or additional layers) to form segment paths that have a substantially same length for all segment paths in the structure. One or more cross-over architectures may be employed per turn. Preferably vertical and lateral cross-over architectures are formed ½ a turn apart and may be formed by via connections (and/or other structures, e.g., extensions, bars, connection lines, etc.) formed through a dielectric layer. The dielectric layer may be deposited over the first metal layer and via holes may be opened up to connect to segments as described above.

In block 806, the same lengths for lateral segment groups (segment pairs) may be achieved by connecting segments on the first layer at an innermost position to a segment on the first layer at an outermost position, and a segment on the first layer at an outermost position to a segment on the first layer at an innermost position. If present, a segment on the first layer is connected at an inner intermediary position to a segment on the first layer at an outer intermediary position, and a segment on the first layer at an outer intermediary position is connected to a segment on the first layer at an inner intermediary position. The lateral segment groups may include multiple metal layers connected by vias.

In block 808, the same lengths for vertical segments (vertical segment pairs) may be achieved by connecting segments on the first layer to segments of another metal layer. For example, a top most layer is connected to a lower layer (the first layer), and if present, vertical segments on an intermediary layers are connected with segments on another intermediary layers to achieve equal vertical lengths. The vertical segments may include multiple metal layers connected by vias.

The cross-over structures are formed by patterning the metal layer(s) and connecting portions of the metal layers. The patterning may include any known process. The corresponding geometry preferably includes an equal number of segments that have a positional relationship with segments of other levels.

Note that the shape and geometry, such as, spiral offsets, spiral size, turn spacings, segment size or number (e.g., thickness/widths or number of segments in a turn, etc.) may be varied in block 810, as described above. In block 812, additional layers or structures (e.g., vias, extensions, connections, etc.) may be added and connected by cross-over architectures or be included by connections to increase conductive cross-section and reduce resistance.

In block 814, parallel connections may be formed to increase segment size by combining adjacent (or non-adjacent) segments at lateral cross-overs. This may include forming composite segments be combining innermost segments on each spiral turn. Having described preferred embodiments for a 3D multipath inductor (which are intended to be illustrative and not limiting), it is noted that modifications and variations can be made by persons skilled in the art in light of the above teachings. It is therefore to be understood that changes may be made in the particular embodiments disclosed which are within the scope of the invention as outlined by the appended claims. Having thus described aspects of the invention, with the details and particularity required by the patent laws, what is claimed and desired protected by Letters Patent is set forth in the appended claims.

What is claimed is:

1. A three-dimensional multipath inductor, comprising:

a plurality of turns disposed about a center region on at least two layers, the turns on the at least two layers having corresponding geometry therebetween;

each of the plurality of turns being comprised of two or more segments that extend length-wise along the turns, the segments having positions that vary from an innermost position relative to the center region and an outermost position relative to the center region;

at least one lateral cross-over configured to couple the segments of at least one turn on one layer with the segments on a turn on a same layer to form segment paths that have a same length for all segment paths in a grouping of segment paths on that same layer; and at least one vertical cross-over configured to couple the segments on different vertically stacked metal layers to have the segment groups with a same length for all segment paths based on vertical lengths.

2. The inductor as recited in claim 1, wherein the at least one lateral cross-over includes a segment at an innermost position connected to an outermost segment position, and a segment at an outermost position connected to an innermost position of the same metal layer.

3. The inductor as recited in claim 1, wherein the at least one lateral cross-over includes a segment at an inner intermediary position connected to a segment on an outer intermediary position, and a segment on an outer intermediary position connected to a segment on an inner intermediary position of the same metal layer.

4. The inductor as recited in claim 1, wherein the at least one lateral cross-over includes both direct and indirect connections between segment portions on opposite sides of the cross-over.

5. The inductor as recited in claim 1, wherein the at least one vertical cross-over includes breaks between segments in a turn and vias and lateral conductors connecting segments at different metal layers.

6. The inductor as recited in claim 1, wherein the at least one vertical cross-over connects segments in a top most layer to segments in a bottom most layer to equalize vertical path lengths.

7. The inductor as recited in claim 1, wherein the at least one vertical cross-over connects segments in a top intermediary layer to segments in a bottom intermediary layer to equalize vertical path lengths.

8. The inductor as recited in claim 1, wherein the inductor includes one of the lateral cross-over or the vertical cross-over at a first position of the inductor and the the lateral cross-over or the vertical cross-over at a second position ½ a turn away.

9. The inductor as recited in claim 1, wherein the turns include at least one of turn width, segment width, segment spacing or turn spacing that varies with distance from the center region.

10. The inductor as recited in claim 1, further comprising at least one additional layer coupled electrically in parallel to one or more of the at least two layers to reduce resistance.

11. A three-dimensional multipath inductor, comprising:

a plurality of turns disposed about a center region on at least two layers, the turns on the at least two layers having corresponding geometry therebetween;

each of the plurality of turns being comprised of two or more segments that extend length-wise along the turns, the segments having positions that vary from an innermost position relative to the center region and an outermost position relative to the center region;

at least one vertical cross-over configured to couple the segments on different vertically stacked metal layers to have the segment groups with a same length for all segment paths based on vertical lengths;

at least one lateral cross-over configured to couple the segments of at least one turn on one layer with the segments on a turn on a same layer to form segment paths that have a same length for all segment paths in a grouping of segment paths on that same layer; and at least one connection between lateral segments to connect two or more segments in parallel on an inner side of the inductor to form a composite segment with increased conductive area.

12. The inductor as recited in claim 11, wherein the at least one lateral cross-over includes a segment at an innermost position connected to an outermost segment position, and a segment at an outermost position connected to an innermost position of the same metal layer.

13. The inductor as recited in claim 11, wherein the at least one lateral cross-over includes a segment at an inner intermediary position connected to a segment on an outer intermediary position, and a segment on an outer intermediary position connected to a segment on an inner intermediary position of the same metal layer.

14. The inductor as recited in claim 11, wherein the at least one lateral cross-over includes both direct and indirect connections between segment portions on opposite sides of the cross-over.

15. The inductor as recited in claim 11, wherein the at least one vertical cross-over includes breaks between segments in a turn and vias and lateral conductors connecting segments at different metal layers.

16. The inductor as recited in claim 11, wherein the at least one vertical cross-over connects segments in a top most layer to segments in a bottom most layer to equalize vertical path lengths.

17. The inductor as recited in claim 11, wherein the at least one vertical cross-over connects segments in a top intermediary layer to segments in a bottom intermediary layer to equalize vertical path lengths.

18. The inductor as recited in claim 11, wherein the inductor includes one of the lateral cross-over or the vertical cross-over at a first position of the inductor and the lateral cross-over or the vertical cross-over at a second position ½ a turn away.

19. The inductor as recited in claim 11, wherein the turns include at least one of turn width, segment width, segment spacing or turn spacing that varies with distance from the center region.

20. The inductor as recited in claim 11, further comprising at least one additional layer coupled electrically in parallel to one or more of the at least two layers to reduce resistance.

21. The inductor as recited in claim 11, wherein the at least one connection between lateral segments connects two or more segments per each turn until all lateral segments are connected at an end of the inductor.

* * * * *